United States Patent [19]

Uytterhoeven et al.

[11] Patent Number: 5,030,612

[45] Date of Patent: Jul. 9, 1991

[54] THERMAL DYE SUBLIMATION TRANSFER RECORDING ELEMENT

[75] Inventors: Herman J. Uytterhoeven, Bonheiden, Belgium; Roderich Raue, Leverkusen; Siegfried Korte, Odenthal, both of Fed. Rep. of Germany

[73] Assignee: Agfa-Gevaert, N.V., Mortsel, Belgium

[21] Appl. No.: 485,566

[22] Filed: Feb. 27, 1990

[30] Foreign Application Priority Data

Feb. 28, 1989 [EP] European Pat. Off. ..... 89200487.0

[51] Int. Cl.[5] ..... B41M 5/035; B41M 5/26

[52] U.S. Cl. ..... 503/227; 8/471; 427/146; 438/195; 438/447; 438/500; 438/913; 438/914

[58] Field of Search ..... 8/471; 428/195, 500, 428/522, 913, 914, 447; 503/227; 427/146

[56] References Cited

U.S. PATENT DOCUMENTS 2,601,256 10/1950 Bruson ..... 260/79.3

2,913,438 11/1959 Davis et al. ..... 260/79.3

*Primary Examiner*—Bruce H. Hess

*Attorney, Agent, or Firm*—Breiner & Breiner

[57] ABSTRACT

Thermal dye sublimation transfer recording element for receiving sublimable basic dye-precursors, comprising a support having thereon a dye-developing layer containing a dye-developing copolymer having sulfonic acid side-groups that can react with the basic dye-precursor to produce a dye image, characterized in that said dye-developing vinyl copolymer comprises plasticizing comonomers, the weight percentage of plasticizing comonomers in the dye-developing vinyl copolymer being such that the glass transition temperature of the dye-developing vinyl copolymer is between 30° C. and 90° C.

7 Claims, No Drawings

THERMAL DYE SUBLIMATION TRANSFER RECORDING ELEMENT

DESCRIPTION

This invention relates to thermal dye sublimation transfer recording, and more particularly, to dye-developing layers of recording elements for use in thermal dye sublimation transfer recording.

In thermal dye sublimation transfer recording a donor element coated with a sublimable coloring material is brought into contact with a recording element and information-wise heated, for example, with a thermal head provided with a plurality of juxtaposed heat generating resistors. Coloring material from the selectively heated regions of the donor element is transferred to the recording element and forms a pattern thereon. The shape and density of this color pattern is in accordance with the pattern and intensity of heat applied to the donor element.

As the coloring material there is used a substance which is prepared by kneading a binder and sublimable dye. Any dye can be used provided it is transferable to the dye-receiving layer of the recording element by the action of heat. Examples of dyes for use in thermal dye sublimation transfer are described in, e.g., EP 209990, EP 209991, EP 216483, EP 218397, EP 227095, EP 227096, EP 229374, EP 257577 and EP 257580.

Also sublimable dye-precursors can be used which, when heated, sublimate to react with a dye-developer present in the recording sheet to produce a dye image. These dye-precursors can be colorless or colored., if colored their color may change by reaction with dye-developer.

A dye-developer contains functional groups which serve as color-developing sites. Sublimated dye-precursors penetrate into the dye-developing layer and chemically combine and/or absorb on the color-developing sites.

The dye-developer can be a low molecular weight compound that is mixed with a binder to form the dye-developing layer. Alternatively, the color-developing sites can be incorporated into the polymeric binder itself, for example, by copolymerization with comonomers containing the color-developing sites. The polymeric binder containing the color-developing sites then forms the color-developing layer.

When basic dye-precursors are used acid groups serve as color-developing sites. For example such acid groups as described in Japanese published patent application no. 84/101395 can be used. Preferably these acid groups are incorporated into the polymeric binder, for example, by copolymerization of monomers containing acid groups such as styrene sulfonic acid or 2-acrylamido,2-methylpropane sulfonic acid with vinyl monomers such as ethylene, propyleen, vinyl chloride, vinylidene chloride, vinyl fluoride, vinylidene fluoride, styrene, vinyl alcohol, acrylic acid, methyl acrylate, methacrylic acid, methyl methacrylate, vinyl acetate and acrylonitrile. Unfortunately depending upon the type of binder incorporating these acid groups the density of the developed color image is not always very high.

It is an object of the present invention to provide a dye-developing layer for basic dye-precursors that yield developed color images with improved density.

Other objects will become apparent from the description hereinafter.

According to the present invention there is provided a recording element for receiving sublimable basic dye-precursors, which comprises a support having thereon a dye-developing layer containing a dye-developing vinyl copolymer having sulfonic acid side-groups that can react with the basic dye-precursor to produce a dye image, characterized in that said dye-developing vinyl copolymer comprises plasticizing comonomers, the weight percentage of plasticizing comonomers in the dye-developing vinyl copolymer being such that the glass transition temperature of the dye-developing vinyl copolymer is between 30° C. and 90° C.

When the glass transition temperature of the dye-developing vinyl copolymer is lower than 30° C., the dye-developing layer may pose problems of adhering to the donor element when heating the assemblage of donor and recording element.

When the glass transition temperature of the dye-developing vinyl copolymer is higher than 90° C., the dye-developing layer cannot sufficiently receive the dye-precursor transferred from the donor element, whereby a clear developed color image cannot be obtained.

By incorporating plasticizing comonomers into the dye-developing vinyl copolymer having sulfonic acid side-groups the glass transition temperature of the copolymer decreases., thus the penetration of the dye-precursor into the dye-developing layer is improved, leading to higher density of the developed color image.

The main constituent units of the dye-developing vinyl copolymer can be, for example, units of ethylene, propyleen, vinyl chloride, vinylidene chloride, vinyl fluoride, vinylidene fluoride, styrene, vinyl alcohol, acrylic acid, methyl acrylate, methacrylic acid, methyl methacrylate, butyl methacrylate, vinyl acetate or acrylonitrile.

Preferably the comonomer containing the sulfonic acid side-group is styrene sulfonic acid or 2-acrylamido,2-methylpropane sulfonic acid or derivatives thereof.

The amount of sulfonic acid side-groups in the dye-developing vinyl copolymer is not very critical as long as a minimum amount of approximately 4 wt % comonomers containing the sulfonic acid side-groups is reached.

Plasticizing comonomers that can be used according to the present invention are, for example, ethyl acrylate, butyl acrylate, octyl acrylate, 2-ethylhexyl acrylate, dodecyl acrylate, butyl methacrylate, heptyl methacrylate, 2-ethylhexyl methacrylate, decyl methacrylate, dodecyl methacrylate, tetradecyl methacrylate, vinyl acetate, vinyl propionate, vinyl butyrate, vinylmethyl ketone, vinylethyl ketone, vinylbutyl ketone, vinyl butyral, vinylidene chloride, vinylidene fluoride, silane, butadiene, isoprene.

The approximate weight percentage of plasticizing comonomers necessary to obtain the desired glass transition temperature of the dye-developing vinyl copolymer ($T_g$) can be calculated in accordance with the formula $$1/T_g = \sum_n w(n)/T_g(n)$$

wherein w(n) refers to the weight fractions of the comonomers, whereas $T_g(n)$ refers to the glass transition temperatures of the corresponding homopolymers.

Examples of copolymers according to the present invention are listed in table 1.

TABLE 1

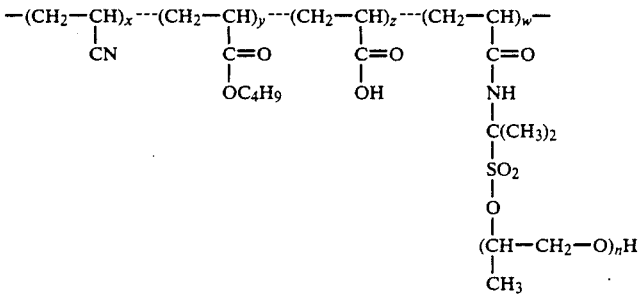

(1.1)

with n=1.8 á 2.0, x=65.8 wt %, y=24.5 wt %, z=4.4 wt %, w=4.8 wt %

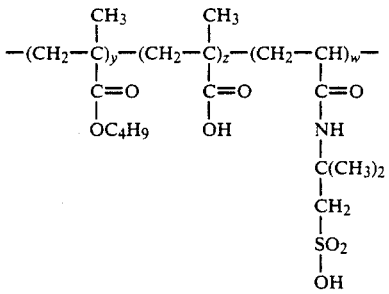

(1.2)

with y=80.4 wt %, z=15.1 wt %, w=4.5 wt %

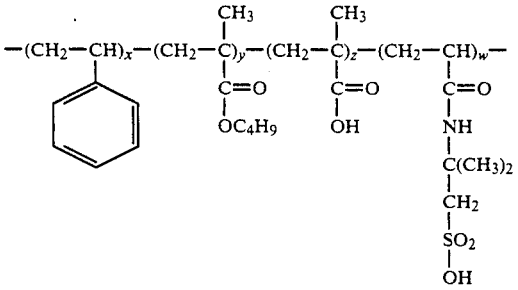

(1.3)

with x=27.1 wt %, y=63.3 wt %, z=5 wt %, w=4.6 wt %

The dye-developing vinyl copolymer according to the present invention can be used as a water-dispersible latex or as a solution in an organic solvent.

In order to improve the light resistance of recorded images and stabilities against other influences, UV absorbers and/or antioxidants may be incorporated into the dye-developing layer.

The support onto which the dye-developing layer of the present invention is coated may be a transparant film such as a poly(ethylene terephthalate), a poly(ether sulfone), a polyimide, a cellulose ester or a poly(vinyl alcohol-co-acetal). The support may also be reflective such as baryta-coated paper, polyethylene-coated paper or white polyester (polyester with white pigment incorporated therein).

The recording element described above is used in combination with a donor element comprising a support and a coloring material layer containing a basic dye-precursor.

Examples of basic dye-precursors are listed in table 2.

TABLE 2

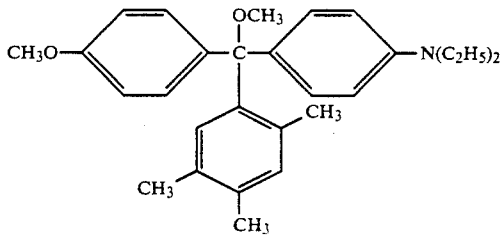

(2.1)

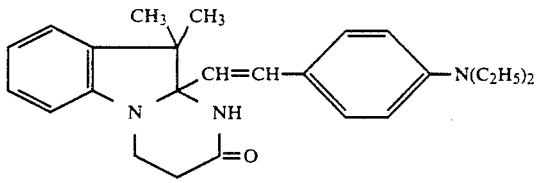

(2.2)

TABLE 2-continued
(2.3)
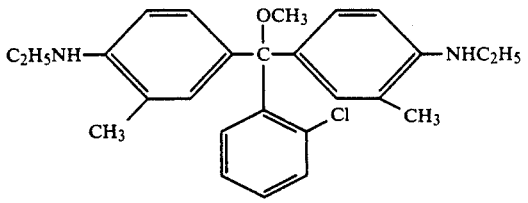
(2.4)
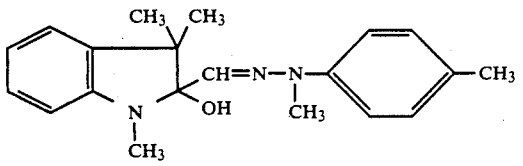
(2.5)
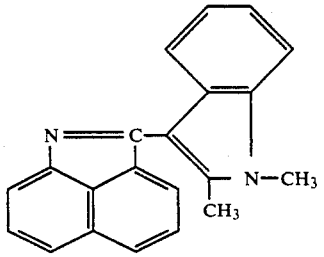
(2.6)
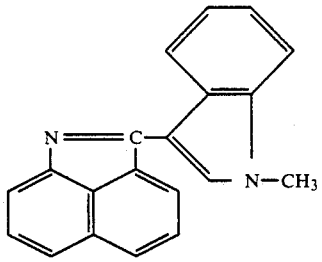
(2.7)
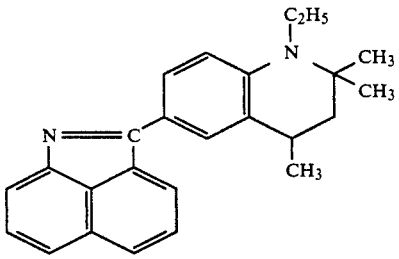
(2.8)
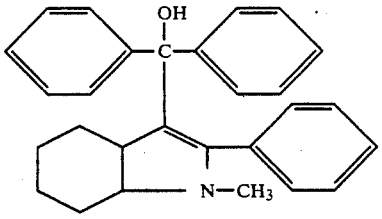
(2.9)
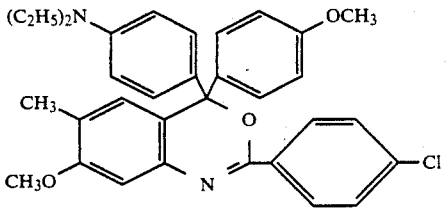

TABLE 2-continued
(2.10)
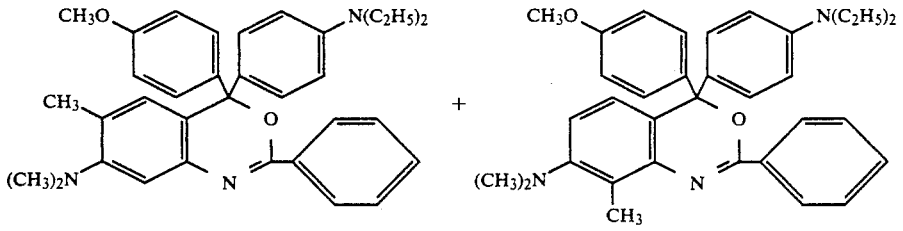
90–92% 8–10%
(2.11)
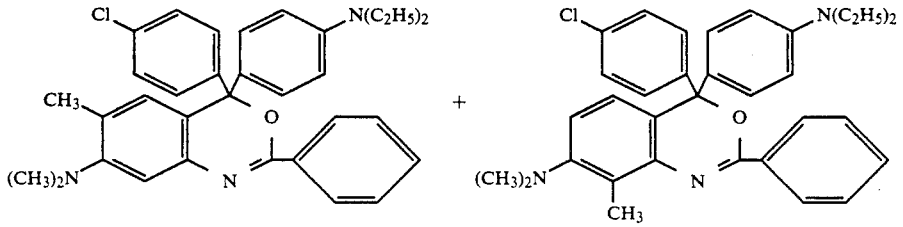
85% 15%
(2.12)
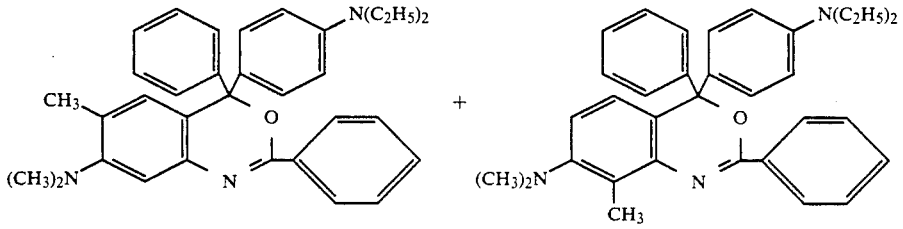
88–90% 10–12%
(2.13)
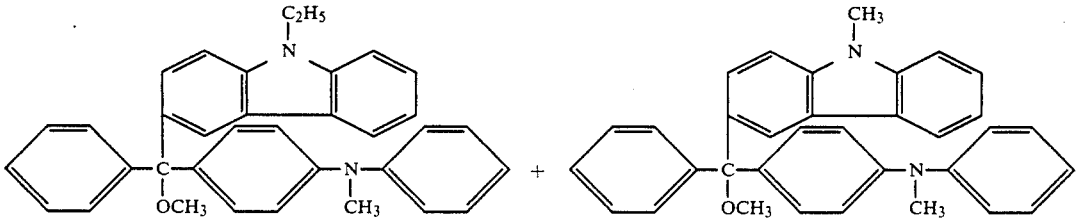
96% 4%
(2.14)
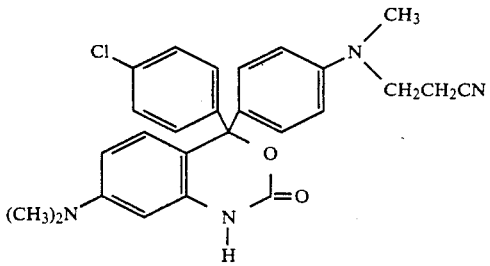
(2.15)
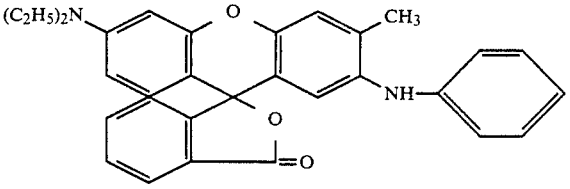

TABLE 2-continued (2.16)

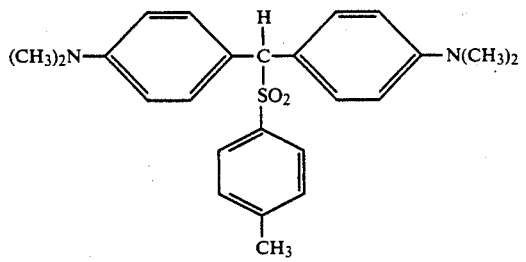

Suitable basic dye-precursors are selected from among the above dye-precursors taking into consideration the heat transfer temperature and efficiency, hue, color rendering and weatherability.

The dye-precursor is dispersed in a suitable synthetic resin binder and then applied onto the support. The following polymeric binders can be used: cellulose derivatives, e.g., cellulose acetate hydrogen phthalate, cellulose acetate, cellulose acetate propionate, cellulose acetate butyrate, cellulose triacetate; vinyl resins and derivatives, such as poly(vinyl alcohol), poly(vinyl acetate), poly(vinyl butyral), poly(vinyl pyrrolidone), polymers and copolymers derived from acrylates and acrylate derivatives, such as poly(acrylic acid), poly(methyl methacrylate) and styrene-acrylate copolymers, polyester resins, polycarbonates, copoly(styrene-acrylonitrile), polysulfones, poly(phenylene oxide), organosilicones, such as polysiloxanes, epoxy resins and natural resins, such as gum arabic, or mixtures thereof.

Any material can be used as the support for the donor element provided it is dimensionally stable and capable of withstanding the temperatures involved, up to 400° C. over a period of up to 20 msec, yet thin enough to transmit heat applied on one side through to the dye-precursor on the other side to effect transfer to the recording element within such short periods, typically from 1 to 10 msec. Such materials include polyesters such as poly(ethylene terephthalate), polyamides, polyacrylates, polycarbonates, cellulose esters, fluorine polymers, polyethers, polyacetals, polyolefins, polyimides, glassine paper and condenser paper. The support may also be coated with a subbing layer, if desired.

The coloring material layer of the donor element may be coated on the support or printed thereon by a printing technique such as a gravure process.

A barrier layer preventing wrong-way transfer of dye-precursor into the support may also be employed in the donor element between its support and the coloring material layer.

The reverse side of the donor element may be coated with a slipping layer to prevent the printing head from sticking to the donor element. Such a slipping layer would comprise a lubricating material such as a surface active agent, a liquid lubricant, a solid lubricant or mixtures thereof, with or without a polymeric binder. The surface active agents may be any of the surface active agents which are known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters.

The donor element employed in certain embodiments of the invention may be used in sheet form or in a continuous roll or ribbon. If a continuous roll or ribbon is employed, it may have only one dye-precursor thereon or may have alternating areas of different dye-precursors leading to different colors, such as cyan, magenta, yellow.

The coloring material layer of the donor element or the dye-developing layer of the recording element may also contain a release agent that aids in separating the donor element from the recording element after transfer. The release agents can also be applied in a separate layer on at least part of the coloring material layer or of the dye-developing layer. For the releasing agent solid waxes, fluorine- or phosphate-containing surfactants and silicone oils can be used.

The coloring material layer of the donor element is placed in face-to-face relation with the color-developing layer and heat printing is carried out from the back of the donor element. The transfer of the dye-precursor is accomplished by heating for about several milliseconds at a temperature of 400° C.

In addition to thermal heads, laser light, infrared flash or heated pens can be used as the heat source for supplying heat energy.

A multicolor image can be obtained by using a donor element containing three primary color dye-precursors and sequentially performing the process steps described above for each color.

The present invention will now be described in detail with reference to the following examples that by no means limit the scope of the present invention.

EXAMPLE 1

As support of the donor element a 5 μm polyethylene terephthalate film was used. The back-side of this support was coated with a slipping layer comprising polyvinyl butyral acetal and a silicon lubricant (polydimethylsiloxane-polyether).

The coloring layer comprised a basic dye-precursor selected from among the basic dye-precursors listed in table 2, dispersed in cellulose acetate propionate binder (dye-precursor/binder 1:1 weight ratio) with tetrahydrofuran or butanone as solvent (total concentration of solids: 1 wt %).

As recording element I a polyethylene coated paper provided with a subbing layer and coated with a dye-developing layer containing: 5 g of dye-developing latex copolymer (1.1) of table 1 (concentration of solids: 31.2 wt %), 0.6 g of polyurethane latex 40 wt %, 0.6 g of polybutyl acrylate latex 20 wt %, wetting agents and B g of water was used.

The above described donor elements were each heat-transfer printed in combination with the above described recording element. The densities of the obtained dye images ($D_{max}$) measured through different color filters are listed below in table 3.

TABLE 3

| no. basic dye-precursor | $D_{max}$ (filter) red | green | blue |
|---|---|---|---|
| 2.1 | 0.14 | 1.68 | 1.05 |
| 2.3 | 1.22 | 0.31 | 0.15 |
| 2.4 | 0.06 | 0.09 | 0.82 |
| 2.6 | 0.08 | 0.84 | 1.03 |
| 2.7 | 1.29 | 1.34 | 0.29 |

EXAMPLE 2

A donor element, prepared as in example 1, containing dye-precursor (2.7), was used.

The following recording elements with dye-developing layers as described below were prepared.

Recording element II: 4 g of latex copolymer (1.1) of table 1, 0.6 g of polybutyl acrylate latex, 1.8 g of polysiloxane-polyether 5 wt % as wetting agent and 10 g of water.

Recording element III: 10 ml of latex copolymer (1.2) of table 1 (18% in water), 0.6 ml polysiloxane-polyether 5 wt % and 10 ml water.

Recording element IV: 10 ml latex copolymer (1.3) of table 1 (19% in water), 0.6 ml polysiloxane-polyether 5% and 10 ml water.

Recording element V: 10 ml of copolymer (23% in water) consisting of 68.5 wt % of acrylonitrile and 31.5 wt % of 2-acrylamido,2-methylpropane sulfonic acid, 1 ml of polysiloxane-polyether 5 wt % and 1 ml of polybutyl acrylate latex 20 wt %.

Recording element VI: 10 ml of copolymer (25% in water) consisting of 74.5 wt % of acrylonitrile and 25.5 wt % of styrene sulfonic acid, 1 ml of polysiloxane-polyether 5 wt % and 0.25 ml of polybutyl acrylate latex 20 wt %.

Recording element VII: 10 ml of copolymer (10 wt % in DMSO) consisting of 67 wt % of acrylonitrile and 32 wt % of 3-methacryl propane sulfonic acid, 0.5 ml of polysiloxane-polyether 5 wt %.

Recording element VIII: 7 ml of copolymer (30 wt % in water) consisting of 5.6 wt % of styrene and 94.4 wt % of styrene sulfonic acid, 0.6 ml of polysiloxane-polyether 5 wt % and 10 ml water.

The above described recording elements were each heat-transfer printed in combination with the above described donor element. the densities of the obtained dye images ($D_{max}$) were measured through a red filter.

The $T_g$ values of the dye-developing copolymers were measured with a Du Pont Model 910 Differential Scanning Calorimeter (DSC).

TABLE 4

| recording element | dye-developing copolymer $T_g$ | $D_{max}$ (filter) red |
|---|---|---|
| II | 85.8° C. | 0.79 |
| III | 64.3° C. | 1.30 |
| IV | 44.4° C. | 0.88 |
| V | 120.4° C. | 0.46 |
| VI | 120.4° C. | 0.66 |
| VII | 134.9° C. | 0.53 |
| VIII | ±100° C. | weak |

The results listed in table 4 clearly show that when the $T_g$ value of the dye-developing copolymer is between 30° C. and 90° C. (as in recording elements II, III and IV) the dyeability of the dye-developing copolymers is very good (D above 0.7). With a $T_g$ above 100° C. the dyeability is poor (recording elements V, VI, VII and VIII).

We claim:

1. Thermal dye sublimation transfer recording element for receiving sublimable basic dye-precursors, comprising a support having thereon a dye-developing layer containing a dye-developing vinyl copolymer having sulfonic acid side-groups that can react with the basIc dye-precursor to produce a dye image, characterized in that said dye-developing vinyl copolymer comprises plasticizing comonomers, the weIght percentage of plasticizing comonomers in the dye-developing vinyl copolymer being such that the glass transItIon temperature of the dye-developing vinyl copolymer Is between 30° C. and 90° C.

2. Thermal dye sublimation transfer recording element according to claim 1 characterized in that the sulfonic acid groups are incorporated into the dye-developing vinyl copolymer by copolymerization oF styrene sulfonic acid or 2-acrylamido,2-methylpropane sulfonic acid with vinyl monomers.

3. Thermal dye sublimation transFer recording element according to claim 1, characterized in that the plasticizing comonomer is butyl acrylate or butyl methacrylate.

4. Thermal dye sublimation transfer recording element according to claim 1, characterized in that the dye-developing vinyl copolymer consists of

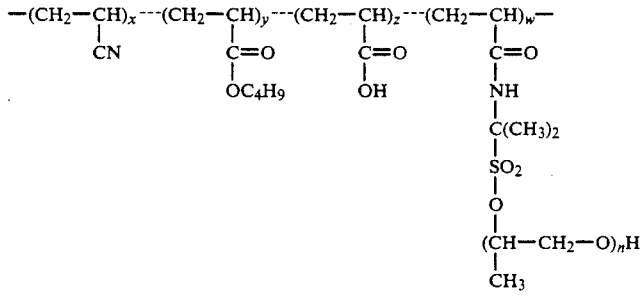

with n=1.8 á 2.0, x=65.8 wt %, y=24.5 wt %, z=4.4 wt %, w=4.8 wt % or

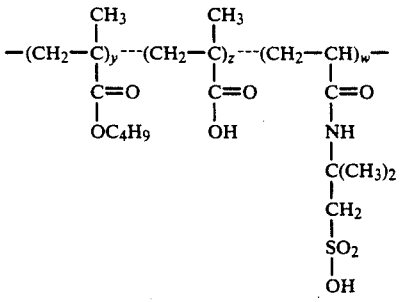

with y=80.4 wt %, z=15.1 wt %, w=4.5 wt % or

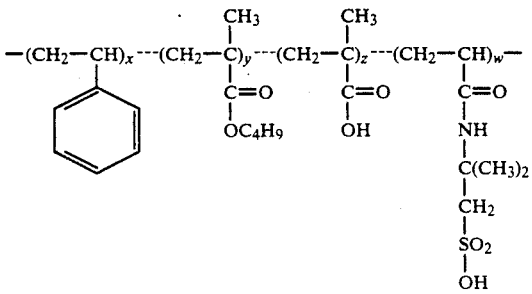

with x=27.1 wt %, Y=63.3 wt %, z=5 wt %, w=4.6 wt %.

5. Thermal dye sublimation transfer recording element according to claim 1, characterized in that the dye-developing layer also comprises a polysiloxane or a polysiloxane-polyether.

6. A process of producing a dye image on a recording element, which comprises heating a donor element containing a sublimable basic dye-precursor so as to cause the dye-precursor to sublime and react with a color developer present in the recording element, characterized in that the recording element is as claimed in claim 1.

7. A process according to claim 6, characterized in that the basic dye-precursor is

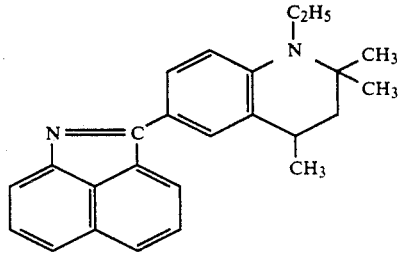

* * * * *